United States Patent [19]

Theurer

[11] Patent Number: 4,640,364

[45] **Date of Patent: * Feb. 3, 1987**

[54] BALLAST CLEANING MACHINE WITH PRELIMINARY SIFTING CONVEYOR

[75] Inventor: Josef Theurer, Vienna, Austria

[73] Assignee: Franz Plasser Bahnbaumaschinen Industriegesellschaft m.b.H., Vienna, Austria

[ * ] Notice: The portion of the term of this patent subsequent to Jul. 23, 2002 has been disclaimed.

[21] Appl. No.: 651,253

[22] Filed: Sep. 17, 1984

[30] Foreign Application Priority Data

Nov. 4, 1983 [AT] Austria ..... 3904/83

[51] Int. Cl.[4] ..... E01B 27/04; E01B 27/02; A01D 17/04; B07B 9/00

[52] U.S. Cl. ..... 171/16; 104/7.1; 171/126; 171/131; 209/234; 209/397; 209/421

[58] Field of Search ..... 171/16, 126, 130, 131; 104/2, 7 R, 7 B, 7 A; 209/420, 421, 397, 234, 324, 320, 307, 308

[56] References Cited

U.S. PATENT DOCUMENTS

| | | | |
|---|---|---|---|
| 1,178,634 | 4/1916 | Drewes | 171/116 |
| 1,238,509 | 8/1917 | Goodwin et al. | 209/420 |
| 1,461,067 | 7/1923 | Moser | 209/234 |
| 1,844,383 | 2/1932 | Davis | 209/324 |
| 1,955,032 | 4/1934 | Stevenson, Jr. | 209/397 |
| 2,085,283 | 6/1937 | Webb | 209/307 |
| 2,142,208 | 1/1939 | Protzeller | 171/16 |
| 2,165,068 | 7/1939 | Protzeller | 171/16 |
| 2,617,600 | 11/1952 | Cole | 209/397 |
| 3,316,977 | 5/1967 | Snoor | 209/421 |
| 3,685,589 | 8/1972 | Plasser et al. | 171/16 |
| 3,900,392 | 8/1975 | Speno et al. | 209/421 |
| 4,178,995 | 12/1979 | Theurer et al. | 171/16 |
| 4,245,703 | 1/1981 | Theurer et al. | 171/16 |
| 4,530,403 | 7/1985 | Theurer et al. | 171/16 |

FOREIGN PATENT DOCUMENTS

| | | | |
|---|---|---|---|
| 2116233 | 9/1983 | United Kingdom | 171/16 |

OTHER PUBLICATIONS

"Perforated Materials", General Catalog Number 75, ©1958,60,62, The Harrington & King Perforating Co. Inc., see pp. 3, 86–87, 131, 135.

*Primary Examiner*—Robert A. Hafer
*Assistant Examiner*—Terrence L. B. Brown
*Attorney, Agent, or Firm*—Kurt Kelman

[57] ABSTRACT

In a ballast cleaning machine which comprises a machine frame, a ballast excavating and conveying chain mounted on the machine frame, the chain having a discharge end for the excavated and conveyed ballast, ballast screening apparatus arranged to receive the ballast from the discharge end of the chain and to separate a waste component from the clean ballast, a conveyor band system mounted below the screening apparatus for receiving the clean ballast component and redistributing it to the track, and an endless conveyor band mounted below the screening apparatus for receiving and conveying the waste component: a sifting conveyor band mounted between the discharge end of the chain and the screening apparatus, the sifting conveyor band having an upper stringer receiving the excavated and conveyed ballast from the discharge end and defining openings permitting a portion of the waste component to pass through the sifting conveyor band, and a drive connected to the sifting conveyor band for driving the band whereby partially cleaned ballast is conveyed from the discharge end of the chain to the screening apparatus.

14 Claims, 8 Drawing Figures

BALLAST CLEANING MACHINE WITH PRELIMINARY SIFTING CONVEYOR

Figures 1, 2, 3, 4, 5, 6, 7, 8:
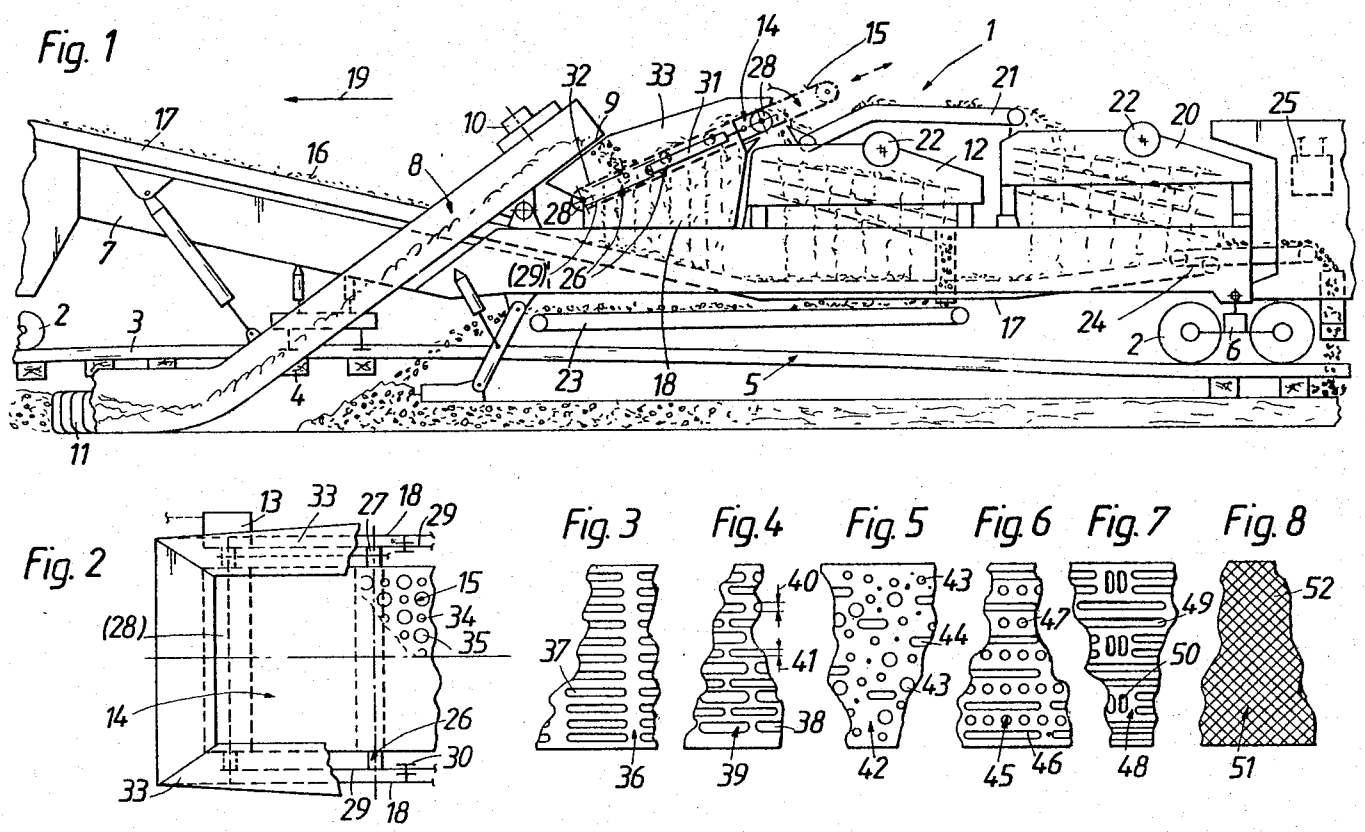

The present invention relates to a track working machine, particularly a ballast cleaning machine, capable of receiving bulk material, particularly ballast, including a waste component from the track, cleaning the received bulk material and conveying the bulk material, which comprises a machine frame, a bulk material excavating and conveying chain mounted on the machine frame, the chain having a discharge end for the excavated and conveyed bulk material, bulk material screening apparatus arranged to receive the bulk material from the discharge end of the chain and to separate the waste component from the clean bulk material, a conveyor band system mounted below the screening apparatus for receiving the clean bulk material component and redistributing it to the track, and an endless conveyor band mounted below the screening apparatus for receiving and conveying the waste component.

UK patent application No. 2,116,233 A, published Sept. 21, 1983, discloses a mobile ballast cleaning machine of this type wherein a vibratory screening installation for cleaning the ballast succeeds the ballast excavating and conveying chain in the operating direction of the machine, and two conveyor bands pivotal in a plane parallel to the track for redistributing the cleaned ballast as well as an endless conveyor band for removing the waste component are arranged below the screening installation. The bottom of the ascending guide channel holding the ballast excavating and conveying chain defines slots for pre-screening the excavated ballast.

U.S. Pat. No. 2,142,208, dated Jan. 3, 1939, relates to apparatus designed only for cleaning the ballast in the track shoulders with two endless excavating chains arranged in series at each shoulder. Two screening grates defining round holes are arranged under the leading excavating chain for respectively depositing smaller ballast stones and the waste on the exposed subgrade of the shoulder. A conveyor band is associated with the trailing excavating chain and a vibratory, obliquely arranged screening grate is mounted below the upper discharge end of this conveyor band for separating the waste from the ballast. While the cleaned ballast is redistributed to the ballast bed by a chute leading from the lower end of the screening grate to the ballast bed, the waste is removed by a conveyor. This machine and its ballast cleaning system is complex in structure while being inefficient wherefore it has not had any commercial success. Cleaning the ballast over the entire width of the track is not possible with this machine.

U.S. Pat. No. 4,178,995, dated Dec. 18, 1979, discloses a ballast cleaning machine with a ballast excavating and conveying chain, a vibratory ballast screen, a waste removal conveyor below the screen and an endless conveyor band conveying the excavated ballast from a discharge end of the chain to the screen. The cleaned ballast is stored adjacent the point where it is excavated and discharged in controlled amounts for redistribution to the track.

U.S. Pat. No. 2,165,068, dated July 4, 1939, relates to a ballast cleaning machine wherein excavated ballast is conveyed over an inclined sifting grate.

It is the primary object of this invention to provide a track working machine of the first-described type having an enhanced cleaning efficiency.

The above and other objects are accomplished according to the invention with a sifting conveyor band mounted between the discharge end of the chain and the screening apparatus. The sifting conveyor band has an upper stringer receiving the excavated and conveyed ballast from the discharge end and defining openings permitting a portion of the waste component to pass through the sifting conveyor band, and a drive is connected to the sifting conveyor band for driving the band whereby partially cleaned ballast is conveyed from the discharge end of the chain to the screening apparatus.

This sifting conveyor produces a pre-screening of the bulk material before it is cleaned on the screening apparatus, which greatly increases the efficiency of the cleaning operation with a minimal increase in construction costs. The sifting conveyor band delivers bulk material containing a substantially reduced amount of waste to the screening apparatus whereby cleaning of the bulk material in the screening apparatus proceeds much more quickly since a reduced portion of the waste component must be separated during cleaning. This, on the other hand, substantially improves the forward speed of the machine during ballast cleaning and, therefore, increases the daily output of the machine. The cleaning operation is further facilitated because the friction between the bulk material particles during their conveyance along a conveyance path extended by the length of the sifting conveyor band is prolonged so that waste adhering to the bulk material is loosened, thus making the separation of the waste in the screening apparatus easier. This is of particular advantage under humid weather conditions tending to promote the bonding of waste to the bulk material. The sifting conveyor band may be used in track working machines incorporated in track renewal trains and standard ballast cleaning machines may be easily retrofitted with such sifting conveyor bands.

The above and other objects, advantages and features of the present invention will become more apparent from the following detailed description of certain now preferred embodiments thereof, taken in conjunction with the accompanying somewhat schematic drawing wherein FIG. 1 shows a fragmentary side elevational view of a ballast cleaning machine with an endless sifting conveyor band according to this invention;

FIG. 2 is an enlarged fragmentary top view of the sifting conveyor band of FIG. 1; and FIGS. 3 to 8 illustrate different embodiments of the openings in the sifting conveyor band, the openings being shown in exaggerated size with respect to the width of the band in an effort to show the opening configurations more clearly.

Referring now to the drawing, FIG. 1 shows a part of a track working machine illustrated as ballast cleaning machine 1 capable of receiving bulk material, i.e. ballast, including a waste component from track 5 comprised of rails 3 fastened to ties 4 supported on the ballast, cleaning the received ballast and conveying the ballast. The machine comprises machine frame 7 mounted on undercarriages 2, 2 for mobility on track 5 in an operating direction indicated by arrow 19. Driven ballast excavating and conveying chain 8 is mounted on machine frame 7 and has discharge end 9 for the excavated and conveyed ballast. Chain 8 is linked to the machine frame by hydraulic adjustment drives for vertical and lateral adjustment in a well known manner. As is conventional, the excavating and conveying chain comprises endless excavating chain 11 having a horizontal section passing transversely under track 5, an ascending section leading from one end of the horizontal section to discharge end 9 and a descending section leading from the discharge end to the other end of the horizontal section. Drive 10 for chain 11 is mounted at the discharge end.

A ballast screening apparatus comprised in the illustrated embodiment of leading vibratory screening installation 12 and trailing vibratory screening installation 20 is arranged on machine frame 7 to receive the ballast from discharge end 9 of the excavating and conveying chain and to separate the waste component from the clean ballast. Each vibratory screening installation has drive 22 for vibrating the installation and a series of superposed screens of different mesh size, all of this structure being generally conventional. As is also known in this type of ballast screening apparatus, conveyor band 21 is arranged between the leading and trailing screening installation for longitudinal displacement in the operating direction. Conveyor band 21 may be so displaced that the excavated ballast is selectively received in one or the other screening installation or in both installations at the same time. A conveyor band system is mounted on machine frame 7 below screening apparatus 12, 20 for receiving the clean ballast component and redistributing it to the track. The illustrated conveyor band system comprises a pair of ballast redistributing conveyor bands 23 which are pivotal in a plane substantially parallel to the track, each conveyor band 23 being associated with a respective track rail 3. An input end of each conveyor band 23 is aligned below a respective chute discharging a cleaned ballast component from leading screening installation 12 and the discharged cleaned ballast component is conveyed from the input end to a discharge end whence it is thrown onto the exposed subgrade for redistribution. The illustrated conveyor band system comprises a further pair of short ballast redistributing conveyor bands 24 also associated with the track rails. These short conveyor bands below trailing sceening installation 20 receive the cleaned ballast component discharged therefrom and convey it to chutes which redistribute the cleaned ballast component behind machine 1. Endless conveyor band 17 is mounted below the screening apparatus centrally between the redistributing conveyor bands for receiving and conveying waste component 16. Further conveyors (not shown) receive the waste component from an output end of endless conveyor band 17 to load the waste component on freight cars preceding machine 1 or dispose of the same in any other desired manner, all of which is well known.

According to this invention, endless sifting conveyor band 14 is mounted between discharge end 9 of the chain and screening apparatus 12, 20, the sifting conveyor band having an upper stringer receiving the excavated and conveyed ballast from the discharge end. The sifting conveyor band defines openings 15 permitting a portion of waste component 16 of the ballast to pass through the sifting conveyor band. Drive 13 is connected to sifting conveyor band 14 for driving the band whereby partially cleaned ballast is conveyed from discharge end 9 of the excavating and conveying chain to screening apparatus 12, 20. In the illustrated embodiment, the sifting conveyor band is mounted directly above endless conveyor band 17 receiving and conveying waste component 16 and is arranged to ascend from discharge end 9 to the screening apparatus, preferably at an angle of 20° to 30°. This saves any additional conveyor means between conveyor bands 14 and 17 since the waste simply falls through openings 15 into conveyor band 17. Because of the inclination of sifting conveyor band 14, some waste always remains behind the ballast conveyed upwardly on the conveyor band so that a larger portion thereof is removed through openings 15.

Machine 1 is operated from control panel 25 arranged in a rear cab on machine frame 7. As is conventional, a track lifting device is mounted on the machine frame for raising the track off the ballast bed at the point of ballast excavation. Also as conventional, a vertically adjustable ballast planing device is mounted on the machine frame behind the point where the clean ballast component is redistributed from the discharge ends of conveyor bands 23 to smooth the redistributed ballast.

The illustrated embodiment of machine 1 comprises protective housing 18 mounted on machine frame 7 below sifting conveyor band 14 so that the portion of waste component 16 passing through openings 15 falls through the protective housing. A series of rollers 30 mounted on protective housing 18 support endless sifting conveyor band 14 thereon. Power drive 31 constituted by a hydraulic cylinder-piston device is connected to sifting conveyor band 14 for displacing the same in the direction of its longitudinal extension and with respect to screening apparatus 12, 20. The illustrated protective housing has protective and limiting walls 33 alongside the two side edges of the upper stringer of sifting conveyor band 14 and the leading end thereof whereby the ballast conveyed on the upper stringer is channeled between the walls and prevented from dropping off the leading sifting conveyor band end. The protective and limiting side walls project beyond a trailing end of the sifting conveyor band adjacent screening apparatus 12, 20. In this manner, the protective housing covers the two side edges and the leading end of the sifting conveyor band. As shown in FIG. 2, protective and limiting walls 33 are inclined to operate in the manner of a funnel and extend to the upper stringer slightly inwardly of the side and end edges thereof, the upper ends of the side walls 33 being affixed to the upper ends of the side walls of housing 18.

The remote-controllable displacement of the sifting conveyor band by drive 31 enables the conveyance path of the excavated ballast to be rapidly and continuously adjusted to adapt the machine operation to prevailing ballast conditions. For example, if the screening apparatus is suddenly overloaded, delivery of further ballast thereto may be temporarily interrupted by so displacing sifting conveyor band 14 that it delivers the excavated ballast directly to waste component conveyor band 17 mounted directly therebelow. The arrangement of the protective and limiting walls prevents any ballast from gliding off the sifting conveyor band even if a considerable amount of ballast is conveyed thereon and/or the sifting conveyor band is vibrated. The protective housing assures that all of the portion of the waste component passing through openings 15 is directed to waste component conveyor band 17 and, furthermore, provides a convenient support for the sifting conveyor band.

As shown in FIG. 2, means 26 is connected to sifting conveyor band 14 for vibrating the same. The illustrated vibrating means comprises a series of crank shafts 27 arranged along the sifting conveyor band in the direction of the longitudinal extension thereof and connected to drive 13 by a suitable motion-transmitting means, such as a transmission belt or chain. The crank shafts as well as rollers 28 about which the sifting conveyor band is trained at respective ends thereof are journaled in two lateral support ledges 29 mounted for displacement on rollers 30. The piston rod of hydraulic displacement drive 31 is connected to the sifting conveyor band to displace between a first position shown in full lines in FIG. 1 and a second position shown in dash-dotted lines, as indicated by the arrows pointing in opposite directions. The cylinder end of displacement drive 31 is connected to protective housing 18. When the sifting conveyor band is displaced into the end position shown in dash-dotted lines, the excavated ballast will fall directly from discharge end 9 onto waste component conveyor band 17.

Sifting conveyor band 14 defines openings 15 whose size has been exaggerated in the drawing for the sake of clearer illustration. The openings are substantially uniformly distributed over the entire width and length of the sifting conveyor band, which provides a maximum number of openings for a high sifting efficiency while maintaining uniform strength for the entire band.

As shown in FIG. 2, openings 34 and 35 of different sizes are provided, which provides an irregular supporting surface for the bulk material to enhance the friction between the bulk material particles whereby the waste component is loosened. Round openings enable larger waste particles or ballast stones which are too small to serve as component of clean ballast to be redistributed to the track to pass through the openings and thus to be removed. Openings 34 and 35 have a size not exceeding the smallest particle size of the ballast still acceptable for the clean ballast component, which is about 30 mm so that the opening sizes preferably range between 10 and 30 mm. This arrangement provides a maximal and trouble-free sifting of the waste component, the selection of the proper opening size preventing ballast stones of a size useful for the clean ballast component from passing through the openings.

FIG. 3 shows a sifting conveyor band 36 with elongated slots 37 extending in the direction of the longitudinal extension of the band, the slots being uniformly distributed in rows. In sifting conveyor band 39 illustrated in FIG. 4, elongated slots 38 are offset in relation to each other in the direction of the longitudinal extension of the band, the widths 40, 41 of alternate slots 38 differing from each other. Width 40 may be about 30 mm while width 41 is about 15 mm. Elongated slot openings in the sifting conveyor band enable the waste component to pass continuously through the openings over a relatively long conveyance path, thus increasing the sifting efficiency. This opening configuration also aids in preventing the waste material from clogging the openings.

In the embodiment shown in FIG. 5, sifting conveyor band 42 defines randomly distributed round openings 43 and elongated slot openings 44. The round openings are of different sizes, thus producing a highly irregular sifting arrangement. Sifting conveyor band 45 shown in FIG. 6 has alternating rows of elongated slots 46 and round openings 47, the rows extending in the direction of the longitudinal extension of the band. In the embodiment of FIG. 7, the openings in sifting conveyor band 48 are so arrayed that two elongated slots 49 extending in the direction of the longitudinal extension of the band alternate with two shorter slots 50 extending perpendicularly thereto. In the transverse direction, pairs of slots 49 are so offset from adjacent pairs of slots 49 that a respective pair of slots 50 is disposed between pairs of slots 49 in the longitudinal direction. Finally, FIG. 8 shows a sifting conveyor band 51 comprised of a mesh formed by intersecting ropes 52 extending at angles of 45° to the direction of the longitudinal extension of the band. The intersecting ropes define uniformly arrayed square openings in the band.

The operation of ballast cleaning machine 1 may be readily derived from the above description of its structure and will be described in more detail hereinbelow.

As soon as ballast excavating and conveying chain 8 has been put in place and drive 10 is actuated to operate the chain, the bulk material consisting of ballast containing a waste component, which fouls the ballast, is excavated and conveyed to discharge end 9 whence it is thrown continuously onto the leading input end of sifting conveyor band 14. Drive 13 drives the band and, at the same time, operates vibrating means 26 to vibrate the moving sifting conveyor band to convey the bulk material to the higher discharge end of the sifting conveyor band while, at the same time, sifting the waste component through openings 15 whereby a pre-screened bulk material is thrown off the discharge end of the sifting conveyor band. Depending on the position of conveyor 21, this pre-screened bulk material will be discharged solely into leading screening installation 12, partially into the leading screening installation and onto conveyor 21 which discharges a portion of the bulk material into trailing screening installation 20, or solely onto conveyor 21 for complete discharge into the trailing screening installation. Waste component 16 sifted through openings 15 in conveyor band 14 falls through housing 18 directly onto conveyor band 17 for removal. The pre-screened bulk material in screening installations 12, 20 passes through the superposed vibratory screens in these installations, the waste component of this screening falling onto conveyor band 17 for removal while the clean ballast component is redistributed by conveyor bands 23 and 24 on the exposed subgrade, all in a well known manner.

The disposition of sifting conveyor band 14 between the discharge end of the ballast excavating and conveying chain and the screening apparatus not only considerably enhances the total efficiency of the machine but also relieves the screening installations. When cleaning heavily encrusted ballast, a large portion of the adhering waste is removed by sifting on conveyor band 14 so that the screening apparatus is able to clean the pre-screened ballast much more rapidly and better. The danger of clogging the vibratory screens in the screening installations by heavy waste is also reduced.

When the ballast is relatively clean, most of the waste component will be removed on the sifting conveyor band so that very little cleaning will have to be done in the screening apparatus, thus considerably improving the efficiency as well as the time required for cleaning the ballast. All of these advantages will be accomplished not only in a ballast cleaning machine of the illustrated type and using two screening installations in series but in any type of track working machine in which bulk material is to be cleaned.

What is claimed is:

1. A ballast cleaning machine capable of receiving ballast including a waste component from the track, cleaning the received ballast and conveying the ballast, which comprises a machine frame, a ballast excavating and conveying chain mounted on the machine frame, the chain having a discharge end for the excavated and conveyed ballast, ballast screening apparatus arranged to receive the ballast from the discharge end of the chain and to separate the waste component from the clean ballast, a conveyor band system mounted below the screening apparatus for receiving the clean ballast component and redistributing it to the track, and an endless conveyor band mounted below the screening apparatus for receiving and conveying the waste component, wherein the improvement comprises an endless sifting conveyor band mounted between the discharge end of the chain and the screening apparatus, the sifting conveyor band having an upper stringer receiving the excavated and conveyed ballast from the discharge end and defining openings permitting a portion of the waste component of said ballast to pass through the sifting conveyor band, the sifting conveyor band being mounted directly above the endless conveyor band whereby the endless conveyor band receives the waste component from the screening apparatus and the portion of the waste component passing through the sifting conveyor band, and a drive connected to the sifting conveyor band for driving the band whereby partially cleaned ballast is conveyed by the sifting conveyor band from the discharge end of the chain to the screening apparatus.

2. The ballast cleaning machine of claim 1, wherein the openings in the sifting conveyor band are substantially uniformly distributed over the entire width and length thereof.

3. The ballast cleaning machine of claim 1, wherein the openings are of different sizes.

4. The ballast cleaning machine of claim 1, wherein at least some of the openings are round.

5. The ballast cleaning machine of claim 1, wherein at least some of the openings are elongated slots extending in the direction of the longitudinal extension of the sifting conveyor band.

6. The ballast cleaning machine of claim 1, wherein at least some of the openings have a size not exceeding the smallest particle size of the ballast still acceptable for the clean ballast component.

7. The ballast cleaning machine of claim 1, wherein the openings have a size between 10 and 30 mm.

8. The ballast cleaning machine of claim 1, further comprising means connected to the sifting conveyor band for vibrating the same, the vibrating means comprising a series of crank shafts arranged along the sifting conveyor band in the direction of the longitudinal extension thereof.

9. The ballast cleaning machine of claim 1, further comprising a protective housing below the sifting conveyor band, the portion of the waste component passing through the openings falling through the protective housing, a series of rollers mounted on the protective housing and supporting the sifting conveyor band thereon along the length thereof, and a power drive connected to the sifting conveyor band for displacing the sifting conveyor band in the direction of its longitudinal extension and with respect to the screening apparatus.

10. The ballast cleaning machine of claim 1, wherein the sifting conveyor band is arranged to ascend from the discharge end of the chain to the screening apparatus.

11. The ballast cleaning machine of claim 10, wherein the sifting conveyor band ascends at an angle of 20° to 30°.

12. The ballast cleaning machine of claim 1, further comprising protective and limiting walls alongside the two side edges of the upper stringer of the sifting conveyor band whereby the bulk material conveyed on the upper stringer is channeled between the walls.

13. The ballast cleaning machine of claim 12, wherein the protective and limiting walls project beyond an end of the sifting conveyor band adjacent the screening apparatus.

14. The ballast cleaning apparatus of claim 1, further comprising a protective housing mounted on the machine frame directly above the endless conveyor band receiving and conveying the waste component, the sifting conveyor band being mounted in the protective housing and the protective housing covering the two side edges and an end thereof adjacent the discharge end of the chain.

* * * * *